United States Patent [19]

Briens et al.

[11] 4,451,353

[45] May 29, 1984

[54] SOLVENT DEWAXING WAXY HYDROCARBON DISTILLATES USING A COMBINATION POLY ACRYLATE POLYMER AND POLYMETHACRYLATE POLYMER DEWAXING AID

[75] Inventors: Cedric L. Briens, Richmond; Bruce M. Sankey; Patrick C. Ewener, both of Sarnia, all of Canada

[73] Assignee: Exxon Research and Engineering Co., Florham Park, N.J.

[21] Appl. No.: 426,676

[22] Filed: Sep. 29, 1982

[51] Int. Cl.[3] ..... C10G 73/04

[52] U.S. Cl. ..... 208/33

[58] Field of Search ..... 208/33

[56] References Cited

U.S. PATENT DOCUMENTS

| | | | |
|---|---|---|---|
| 2,798,027 | 7/1957 | Cohen et al. | 196/19 |
| 3,239,445 | 3/1966 | Leonard et al. | 208/33 |
| 3,262,873 | 7/1966 | Tiedje et al. | 208/33 |
| 3,458,430 | 7/1969 | Henselman et al. | 208/33 |
| 3,458,430 | 7/1969 | Henselman et al. | 208/33 |
| 3,479,278 | 11/1969 | DeVault | 208/33 |
| 3,729,296 | 4/1973 | Miller | 44/62 |
| 3,806,442 | 4/1974 | Reid et al. | 208/33 |
| 4,088,589 | 5/1978 | Rossi et al. | 252/56 |
| 4,153,423 | 5/1979 | Wisotsky | 44/62 |
| 4,191,631 | 3/1980 | Grisham | 208/33 |

FOREIGN PATENT DOCUMENTS

| | | | |
|---|---|---|---|
| 2113780 | 6/1972 | France . | |
| 45-44516 | 5/1970 | Japan . | |
| 45-122277 | 12/1970 | Japan . | |
| 45-122276 | 12/1970 | Japan . | |
| 52-44261 | 4/1977 | Japan . | |
| 52-77382 | 6/1977 | Japan . | |
| 945828 | 1/1964 | United Kingdom | 208/33 |
| 1145427 | 3/1969 | United Kingdom | 208/33 |
| 1151385 | 5/1969 | United Kingdom . | |
| 810668 | 12/1978 | U.S.S.R. . | |

*Primary Examiner*—Delbert E. Gantz
*Assistant Examiner*—Glenn A. Caldarola
*Attorney, Agent, or Firm*—Joseph J. Allocca

[57] ABSTRACT

This invention relates to solvent dewaxing processes, for dewaxing waxy hydrocarbon oils using a dewaxing aid, which dewaxing aid comprises a mixture of (A) polyalkyl arcylate having alkyl group side chain length of from 10–26 carbons (excluding branching) and (B) an n-alkyl methacrylate polymer having alkyl group side chain length of from 10–20 carbons (excluding branching). Component (A) typically has a number average molecular weight of from 3,000 to 500,000 while component (B) typically has a number average molecular weight of from 5,000 to 200,000. The combination (A) plus (B) may be employed in a weight ratio within the range from about 1/100 to 100/1, preferably about 1/6 to 2/1 and at an aid does level ranging from about 0.01 wt % to 1 wt %, preferably 0.02 to 0.2 wt % active ingredient.

10 Claims, 1 Drawing Figure

INFLUENCE OF POLYALKYLACYLATE / POLYALKYLMETH-ACRYLATE CONCENTRATION RATIO ON THE FEED FILTER RATE AND THE DEWAXED OIL YIELD

INCREMENTAL DILUTION-DISTILLATE (600N)
(Total Dewaxing Aid Concentration: 0.1 Wt % as received on Feed)

INFLUENCE OF POLYALKYLACYLATE / POLYALKYLMETH-ACRYLATE CONCENTRATION RATIO ON THE FEED FILTER RATE AND THE DEWAXED OIL YIELD

INCREMENTAL DILUTION-DISTILLATE (600N)
(Total Dewaxing Aid Concentration: 0.1 Wt % as received on Feed)

SOLVENT DEWAXING WAXY HYDROCARBON DISTILLATES USING A COMBINATION POLY ACRYLATE POLYMER AND POLYMETHACRYLATE POLYMER DEWAXING AID

DESCRIPTION OF THE INVENTION

This invention relates to solvent dewaxing processes, for dewaxing waxy hydrocarbon oils using a dewaxing aid, which dewaxing aid comprises a mixture of (A) polyalkyl acrylate having alkyl group side chain length of from 10–26 carbons (excluding branching) and (B) an n-alkyl methacrylate polymer having alkyl group side chain length of from 10–20 carbons (excluding branching). Component (A) typically has a number average molecular weight of from about 3,000 to 300,000 while component (B) typically has a number average molecular weight of from about 5,000 to 200,000. The combination (A) plus (B) may be employed in a weight ratio within the range from about 1/100 to 100/1, preferably about 1/6 to 2/1 and at an aid does level ranging from about 0.01 wt % to 1 wt %, preferably about 0.02 to 0.2 wt % active ingredient. Typical examples of polyalkylacrylates (component A) are those materials described in U.S. Pat. No. 4,191,631 (incorporated herein by reference) and GB Pat. No. 1,145,427 and which are commonly known in the art as Shellswim (manufactured by the Shell Oil Company). Typical examples of n-alkyl methacrylate polymers (Compound B) are those materials manufactured by Rohm and Haas Company and identified as Acryloids and described in U.S. Pat. Nos. 4,153,423, 2,091,627 and 2,100,993.

This dewaxing aid combination aids in solvent dewaxing processes wherein a waxy hydrocarbon oil distillate is mixed with a dewaxing solvent and a quantity of the recited dewaxing aid combination to form a mixture which is chilled either directly using cold dewaxing solvent or indirectly in heat exchange apparatus to form a slurry comprising wax particles and a solution of dewaxed oil and dewaxing solvent. The dewaxing aid components (a) and (b) may be precombined one with the other for addition to the waxy oil distillate to be dewaxed, either as such or diluted in a suitable wax-free oil to improve flow properties. Alternatively, the components may be added separately and simultaneously or separately and sequentially at the same or separate points within the process. Even in this embodiment the individual components (a) and (b) may be employed as such or diluted in a suitable wax-free oil to improve flow properties. The wax particles which are precipitated are subsequently separated from the dewaxed oil by any of a number of typical liquid/solid separation processes exemplified by, but not limited to, filtration, settling, centrifugation, etc.

The use of the combinaton (a) plus (b) results in increased separation rates as compared to using no aid at all or using either component individually.

BACKGROUND OF THE INVENTION

Waxes in wax-containing hydrocarbon oils are removed therefrom by chilling the oil to precipitate out the wax and then separating the solid wax particles from the dewaxed oil by solid/liquid separation procedures such as filtration, centrifugation, settling, etc. Industrial dewaxing processes include press dewaxing processes wherein the wax-containing oil, in the absence of solvent, is chilled to crystallize out the wax particles, which are then pressed out by a filter. In general, only light hydrocarbon oil fractions are treated by press dewaxing processes due to viscosity limitations. More widely used are solvent dewaxing processes wherein a waxy oil is mixed with a solvent and then chilled to precipitate the wax as tiny particles or crystals thereby forming a slurry comprising solid wax particles and a solution of dewaxed oil containing dewaxing solvent. The slurry is then fed to a wax separator (e.g. filter) wherein the wax is removed from the dewaxed oil and dewaxing solvent. Solvent dewaxing processes are used for heavier oil fraction such as lubricating oil fractions and bright stocks. Typical dewaxing solvents include low boiling point, normally gaseous autorefrigerative hydrocarbons such as propane, propylene, butane, pentane, etc., ketones such as acetone, methyl ethyl ketone (MEK), methyl isobutyl ketone (MIBK) and mixtures thereof, aromatic hydrocarbons such as benzene, toluene and xylene as well as mixtures of ketones and aromatic hydrocarbons such as MEK/toluene and acetone/benzene and mixtures of ketones with autorefrigerants such as acetone/propylene.

One of the factors tending to limit the capacity of a solvent dewaxing plant is the rate of wax filtration (and separation in general) from the dewaxed oil, which in turn is strongly influenced by the crystal structure of the precipitated wax. Although the crystal structure of the precipitated wax is influenced by various operating conditions in the dewaxing process, for any given feed it is most strongly influenced by the chilling conditions. The size and crystal structure of the precipitated wax, occlusion of oil in the wax crystal and the condition of the oil left in the crystal are extremely varied and depend on the wax composition and precipitation conditions. These conditions also affect the separation (filtration) rate of the dewaxed oil from the wax and the yield of dewaxed oil. In some cases, most notably when the waxy oil is a bright stock, the wax crystals are of an extremely fine size and not all are separated by filtration, but some leave the filter with the dewaxed oil component which creates an objectionable haze in the oil.

One way of improving the filtration rate and minimizing haze formation is to add a dewaxing aid to the wax containing oil during the dewaxing process. Well known in the industry are dewaxing aids such as $\alpha$-olefin copolymers; mixtures of materials such as a mixture of (a) an ethylene-vinyl acetate copolymer and (b) an ester of an aliphatic alcohol having from 2 to 20 carbon atoms with acrylic or methacrylic acid; materials such as the esters of aliphatic alcohols and acrylic or methacrylic acid, as well as polymeric dewaxing aids comprising condensation products of chlorinated paraffins and naphthalenes alone or mixed with the aforementioned esters. However, in the case of heavy stocks, these aids are not too efficient, requiring a relatively high concentration of the dewaxing aid in the oil. This is especially true when a heavy oil raffinate or a bright stock or heavy distillate is solvent dewaxed. Because of the presence of many fine particles of wax in the oil, the filter rate of the dewaxed oil tends to be low and the oil also may possess or develop a haze.

PRESENT INVENTION

Figure 1:
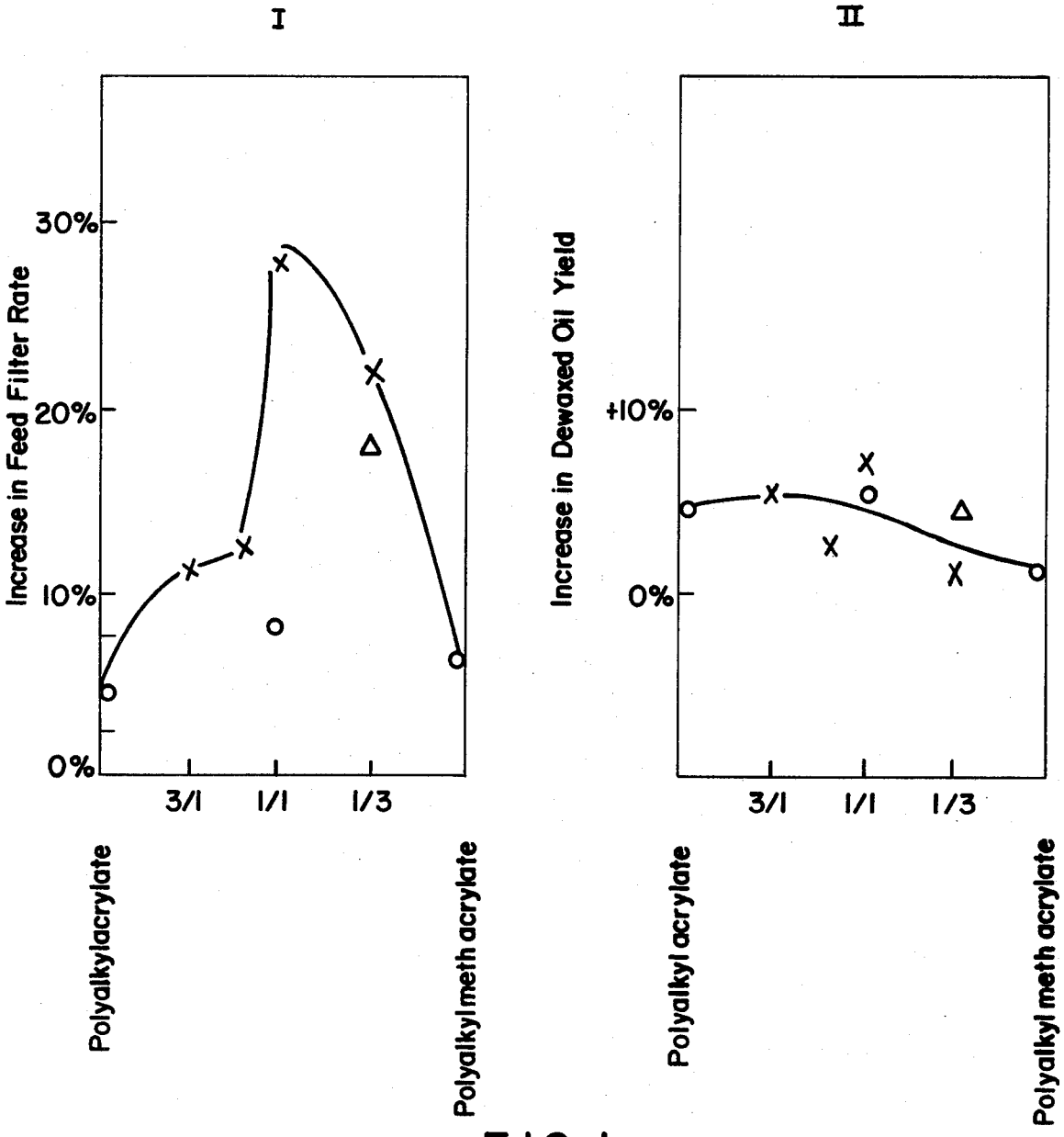
FIG. 1 (I and II) presents the effect on feed filter rate and dewaxed oil yield of the concentration ratio of the components of the dewaxing aid combination used in the present invention to dewax distillate.

This invention relates to solvent dewaxing processes, for dewaxing waxy hydrocarbon oils using a dewaxing aid, which dewaxing aid comprises a mixture of (A) poly alkyl acrylate having alkyl group side chain length of from 10–26 (preferably with a preponderance of $C_{16}$+) carbon atoms in the alkyl group (excluding branching) and (B) an n-alkyl methacrylate polymer having alkyl group side chain length of from 10–20 carbon atoms (excluding branching). Component (A) typically has a number average molecular weight of from about 3,000 to 300,000 while component (B) typically has a number average molecular weight of from about 5,000 to 200,000. The combination (A) plus (B) may be employed in a weight ratio within the range from about 1/100 to 100/1, preferably about 1/6 to 2/1 and at an aid does level ranging from about 0.01 wt % to 1 wt %, preferably about 0.02 to 0.2 wt % active ingredient. Typical examples of polyalkylacrylates (component A) are those materials described in U.S. Pat. No. 4,191,631 (incorporated herein by reference) and GB Pat. No. 1,145,427 and which are commonly known in the art as Shellswim (manufactured by the Shell Oil Company). Typical examples of n-alkyl methacrylates (component B) are those materials manufactured by Rohm and Haas Company and identified as Acryloids.

This dewaxing aid is advantageously employed as separately prepared components (a) and (b). These components may then be mixed together in the previously recited ratios and added at the desired dose level, either as such or dissolved in a suitable wax-free oil such as mineral oil or other suitable solvent such as toluene, benzene, propane, methylene chloride and the like which imparts to the additive improved flow properties, pumpability, etc. Alternatively, the individual components (a) and (b) can be employed separately (either as such or dissolved in a solvent as previously indicated) and introduced to the dewaxing process simultaneously or sequentially at separate points within the process. The aid, regardless of whether both components are pre-mixed one with the other, or employed separately/simultaneously or separately/sequentially with or without dilution, may be either mixed with the waxy oil prior to chilling, or introduced during the chilling process in either indirect chilling means, such as scraped surface chillers, or alternatively, in direct chilling means employing cold solvent. Preferred direct chilling means employing cold solvent injected along a number of stages therein a number of which stages are highly agitated insuring instantaneous mixing is the DILCHILL® (registered service mark of Exxon Research and Engineering Company) process as presented in U.S. Pat. No. 3,773,650, hereby incorporated by reference.

The polyalkyl methacrylate used as component B has from 10–20 carbon atoms in the alkyl group side chain (excluding branching), preferably 12 to 18 carbon atoms and is typically the polymer of the ester of a 10–20 carbon atom substantially linear aliphatic alcohol with methacrylic acid. The polymer will have a number average molecular weight of from about 5,000 to 200,000 preferably 10,000 to 100,000. Commercial polyalkyl methacrylates possessing the desired characteristics for use in this invention are Acryloid 144 and Acryloid 150 manufactured by Rohm and Haas Company. Acryloid 144 is described as having an average side chain length of >50% $C_{16}$ and higher and a number average molecular weight of about 5,000 to 200,000 while Acryloid 150 is described as having an average side chain length of >50% $C_{14}$ and lower and a number average molecular weight of about 5,000 to 200,000.

Samples of the materials representative of those both within the scope and outside the scope of the present invention and employed in the Examples of this specification were examined and were determined to have the following general characteristics.

A representative poly alkyl methacrylate copolymer of the type identified as Acryloid 150 having predominantly $C_{12}$–$C_{16}$ pendent alkyl side chains (2% $C_{10}$ and less, 30% $C_{12}$, 27% $C_{14}$, 14% $C_{16}$, 16% $C_{18}$, 11% $C_{20}$+) possessed a number average molecular weight of about 62,200 and a weight average molecular weight of about 284,000, with a 10–90 mol.% number average molecular weight of about 5,000 to 20,000.

A representative poly alkyl methacrylate copolymer of the type identified as Acryloid 144 having predominantly $C_{16}$–$C_{18}$ pendent alkyl side chains (4% $C_{12}$ and less, 7% $C_{14}$, 39% $C_{16}$, 45% $C_{18}$, 5% $C_{20}$+) possessed a number average molecular weight of about 33,300, a weight average molecular weight of about 205,800, with a 10–90 mol.% number average molecular weight of about 5,000 to 75,000.

Molecular weights were determined by gel permeation chromatography calibrated on polystyrene.

While the samples presented above were not the exact samples employed in the Examples of the present specification, it is believed they are fairly representative of such samples and serve to demonstrate the general characteristics of materials which satisfy the requirement of the present invention, as well as of those which do not so satisfy those requirements.

The polyalkyl acrylate used as Component A has from 10 to 26 (preferably with a preponderance of $C_{16}$ or more) carbon atoms in the alkyl side chain group (excluding branching, preferably 18 to 22 carbon atoms and is typically the polymer of the ester of a 10 to 26 carbon atom substantially linear aliphatic alcohol with acrylic acid. The polymer will have a number average molecular weight of from about 3,000 to 300,000 preferably about 20,000 to 100,000. Commercial polyalkyl acrylates possessing the desired characteristics for use in this invention are Shellswim 5X manufactured by the Shell Oil Company. The polyalkyl acrylate known as Shellswim 5 is a poly n-$C_{20}$ average alkyl acrylate and in a specific instance is reported as having a wt. average mol. wt. ~220,000; no. average mol. wt. ~60,000 in which the alkyl is ~45% $C_{18}$, ~10% $C_{20}$ and ~45% $C_{22}$. (See U.S. Pat. No. 4,191,631).

The dewaxing solvent that is used in the present invention is not particularly critical; thus, any of the well-known normally liquid dewaxing solvents can be used. For example, there may be used ketones having from 3 to 6 carbon atoms, such as acetone, dimethyl ketone, methyl ethyl ketone, methyl propyl ketone and methyl isobutyl ketone and mixture thereof, aromatic hydrocarbons such as benzene, xylene or toluene, mixtures of ketones with aromatic hydrocarbons such as methyl ethyl ketone/toluene or methyl isobutyl ketone/toluene. Also useful are halogenated hydrocarbons such as methylene chloride. Further, N-alkylpyrrolidones such as N-methyl-pyrrolidone and N-ethyl-pyrrolidone may be used as the dewaxing solvent. Solvents which may be especially preferred for practicing the process of the present invention include MEK, MIBK, MEK/MIBK mixture, toluene, mixtures of a ketone and an aromatic hydrocarbon such as MEK/toluene, methylene chloride and mixtures of acetone and methylene chloride.

The waxy oils treated by the process of the present invention employing the above-recited dewaxing aids are waxy oils derived from distillates which typically have a boiling range of 300° C. to 600° C., a density of about 0.80–0.90 g/cc @ 15° C., a viscosity of about 3 to 12 cSt/100° C, a pour point of about 30° to 50° C. and a dry wax content of about 10 to 25 wt.%. A typical 600N distillate was examined and found to have a boiling range of 400° to 550° C., a density of 0.8745 g/cc @ 15° C., a viscosity of 10.1 cSt/100° C., a pour point of 50° C. and a dry wax content of 21 wt.%.

These distillates can be obtained from any convenient source such as paraffinic crudes (Aramco, Kuwait, the Panhandle, North Louisiana, etc.) naphthenic crudes (Tia Juana, Coastal, etc.), bright stocks and synthetic feedstocks such as those derived from tar sand oils, Cold Lake crude oil, shale oil, coal oils, etc.

The most preferred stocks are the distillate cut fractions which include lubricating oils and specialty oil fractions boiling within the range of 300° to 600° C., preferably possessing a mid boiling point of about 450°–550° C. Typical examples of such distillates are 600N oils derived from Arab Light. Such an oil, a Light Arabian 600N distillate, is a heavy lube oil base stock having a viscosity of about 100 cSt at 40° C. (600 SUS at 100° F.).

In an embodiment of the process of this invention, a solution of dewaxing aid comprising components (a) and (b) dissolved in an appropriate solvent such as a light heating oil or a light dewaxed mineral oil fraction is mixed into the wax-containing oil and the mixture heated to a temperature higher than the cloud point of the oil (about 50° to 120° C.). This mixture is introduced, along with the dewaxing solvent, into a chilling zone and chilled to a temperature necessary to yield the desired pour point for the resulting dewaxed oil. The chilling produces a slurry comprising dewaxed oil and solvent along with solid particles of wax which contain the dewaxing aid. This slurry is then sent to a wax filter to separate the dewaxed oil and solvent from the wax particles. The dewaxing temperature or temperature to which the slurry is chilled varies depending on the feed and conditions. In general, this temperature will range from about 0° to about −50° C. In the case where the dewaxing solvent comprises a mixture of a ketone and an aromatic hydrocarbon, such as methyl ethyl ketone/toluene, the dewaxing temperature will range from about −10° to about −30° C. In a preferred embodiment the waxy oil is introduced into a staged chilling zone and passed from stage to stage while cold dewaxing solvent is injected into a plurality of the stages wherein a high degree of agitation is maintained in the stage so as to effect substantially instantaneous mixing of the waxy oil and cold dewaxing solvent. The dewaxing aid of the present invention made up of (a) polyalkyl acrylate and (b) polyalkyl methacrylate may be injected along with the cold dilution chilling solvents or may be premixed with the waxy oil to be dewaxed.

Preferred dewaxing solvents used in the process of this invention include a mixture of a ketone and an aromatic hydrocarbon as well as a mixture of a ketone and methylene chloride. The ratio of solvent to waxy oil would generally range from about 0.5 to 10 and preferably from about 2 to 7, by volume. The optimum amount of dewaxing solvent employed is, of course, determined by the wax content of the oil, viscosity, pretreatment and dewaxing conditions.

EXAMPLE

Waxy 600N distillates with nominal boiling ranges of about 400°–550° C. and viscosities of about 10.1 cSt at 100° C. were dewaxed in a bench scale vertical scraper. It comprised a 13 cm ID steel cylinder which was 30 cm high. The walls were scraped by two vertical aluminum blades which were attached to a central shaft rotating at 28 rpm. Chilling of the scraper contents was accomplished by immersion in a refrigerant bath. The chilling rate of the scraper contents was about 5° C./min.

The dewaxing aid combination to be tested (which had already been mixed) was added to the waxy feed to give the specified treat rate at about 70° C. The treated feed was then mixed with the predilution solvent and introduced into the scraper. The mixture was then chilled progressively and the solvent increments were added at appropriate temperatures. When the filtration temperature (about −10° C.) was reached, the scraper was removed and the filtration performance of the wax slurry was measured with a small vacuum leaf filter at a vacuum of 12 in. Hg.

The solvent used in the following examples was a 45/55 mixture of methyl-ethyl ketone and methyl-isobutyl ketone. The dilution ratio at filtration was 2.5 volumes of ketone solvent per volume of waxy feed.

Commercial examples of dewaxing aid component (A) (Shellswim 5X a polyalkylacrylate synthesized in xylene solvent and Shellswim 5T, a comparable polyalkylacrylate synthesized in toluene solvent, from Shell) and a commercial example of dewaxing aid component (B) (Acryloid 144 from Rohm and Haas) were tested on samples of 600N distillates. The dewaxing aid concentrations as employed in the table are given on a "as received" basis. (The amount of Active Ingredient present in commercial materials representative of the types employed in the examples are typically as follows; materials representative of those tested as Component A are about 40 wt% active ingredient and materials representative of Component B are about 27 wt% active ingredient.) Table I shows the results thus obtained with dewaxing aid concentrations (as received) of 0.1 wt% and 0.2 wt% (on feed) on a Strathcona 600N distillate. Table II shows the results obtained with dewaxing aid concentrations (as received) of 0.1 wt% and 0.2 wt% (on feed) on a Sarnia 600N distillate. FIG. 1 presents the combined data from Tables I and II and shows the synergistic effect which is observed when Shellswim 5X or Shellswim 5T (component type A) is used in combination with Acryloid 144 (component type B) at a concentration level total of 0.1 wt% as received (on feed) on samples of 600N distillates.

TABLE I

EXPERIMENTS ON STRATHCONA 600N DISTILLATE

| Dewaxing Aid Mixtures | DWA Concentration (Wt % As Received) | Improvement in Feed Filter Rate | Change in DWO Yield |
|---|---|---|---|
| Shellswim 5T | 0.1 | 22% | +6% |
| Acryloid 144 | 0.1 | | |
| Shellswim 5T | 0.05 | 23% | +6% |
| Acryloid 144 | 0.15 | | |
| Shellswim 5T(1) | 0.025 | 17% | +4% |
| Acryloid 144 | 0.075 | | |
| Shellswim 5X | 0.05 | 35% | +8% |
| Acryloid 144 | 0.15 | | |

TABLE I-continued

EXPERIMENTS ON STRATHCONA 600N DISTILLATE

| Dewaxing Aid Mixtures | DWA Concentration (Wt % As Received) | Improvement in Feed Filter Rate | Change in DWO Yield |
|---|---|---|---|
| Shellswim 5X[2] | 0.025 | 22% | +1% |
| Acryloid 144 | 0.075 | | |
| Shellswim 5X[2] | 0.05 | 28% | +7% |
| Acryloid 144 | 0.05 | | |
| Shellswim 5X[2] | 0.075 | 11% | +5% |
| Acryloid 144 | 0.025 | | |
| Shellswim 5X[2] | 0.06 | 12% | +2% |
| Acryloid 144 | 0.04 | | |

[1]The combination is presented in FIG. 1 by a Δ.
[2]The combination is presented in FIG. 1 by an X.

TABLE II

EVALUATION OF DEWAXING AID MIXTURE ON A SARNIA 600N DISTILLATE

| | DWA Concentration (Wt % As Received) | Improvement in Feed Filter Rate | Change in Dewaxed Oil Yield |
|---|---|---|---|
| A. Single Components | | | |
| Shellswim 5T[1] | 0.1 | 4% | +4% |
| Acryloid 144[1] | 0.1 | 5% | +1% |
| B. Mixtures | | | |
| Shellswim 5T | 0.05 | 20% | +5% |
| Acryloid 144 | 0.15 | | |
| Shellswim 5T | 0.1 | 19% | +5% |
| Acryloid 144 | 0.1 | | |
| Shellswim 5T[1] | 0.05 | 8% | +5% |
| Acryloid 144 | 0.05 | | |

[1]The individual materials and the combination from this Table are presented in FIG. 1 by a O.

What is claimed is:

1. A solvent dewaxing process comprising mixing a waxy hydrocarbon oil distillate with dewaxing solvent and dewaxing aid wherein said dewaxing aid comprises a mixture of:

A. a poly acrylate; and

B. an n-alkyl methacrylate polymer; wherein components (A) and (B) constituting the dewaxing aid are used in a weight ratio to each other ranging from about 1/100 to 100/1 of (A)/(B), and chilling said oil/dewaxing solvent/dewaxing aid mixture to form a slurry comprising solid particles of wax and a solution of dewaxed oil and dewaxing solvent and separating said wax from said dewaxed oil solution.

2. The process of claim 1 wherein said poly alkyl acrylate has alkyl side chain group length of from 10–26 carbon atoms and wherein said n-alkyl methacrylate polymer has alkyl side chain group length of from 10–20 carbon atoms.

3. The process of claim 1 or 2 wherein said poly alkyl acrylate has a preponderance of $C_{16}+$ carbon atoms in the alkyl group and has a number average molecular weight of from 3,000 to 500,000 and wherein said n-alkyl methacrylate polymer has a number average molecular weight of about 5,000 to 200,000.

4. The process of claim 1 or 2 wherein said dewaxing aid is employed at a dose level ranging from about 0.01 to 1 wt.% active ingredient.

5. The process of claim 3 wherein said dewaxing aid is employed at a dose level ranging from about 0.01 to 1 wt.% active ingredient.

6. The process of claim 4 wherein components (a) and (b) constituting the dewaxing aid are used in a weight ratio to each other ranging from about 1/6 to 2/1 of a (a)/(b).

7. The process of claim 5 wherein components (a) and (b) constituting the dewaxing aid are used in a weight ratio to each other ranging from about 1/6 to 2/1 of (a)/(b).

8. The process of claim 6 wherein said dewaxing solvent is (1) a $C_3$–$C_6$ ketone and mixtures thereof; (2) aromatic hydrocarbons; (3) mixtures of ketones and aromatic hydrocarbons; (4) halogenated hydrocarbons; (5) N-alkyl-pyrrolidones; (6) mixtures of acetone and methylene chloride.

9. The process of claim 7 wherein said dewaxing solvent is (1) a $C_3$–$C_6$ ketone and mixtures thereof; (2) aromatic hydrocarbons; (3) mixtures of ketones and aromatic hydrocarbons; (4) halogenated hydrocarbons; (5) N-alkyl-pyrrolidones; (6) mixtues of acetone and methylene chloride.

10. The process of claim 1 or 2 wherein said waxy hydrocarbon oil distillate is a natural or synthetic lube oil fraction.

* * * * *